US009234701B2

(12) United States Patent
Wada et al.

(10) Patent No.: US 9,234,701 B2
(45) Date of Patent: Jan. 12, 2016

(54) CRUSHING DRYING DEVICE

(75) Inventors: Naoya Wada, Kobe (JP); Katsu Matsumoto, Kakogawa (JP); Hiroaki Kajiyama, Akashi (JP); Masuyuki Mieda, Himeji (JP); Kazuhiro Yamamoto, Kasai (JP); Natsuki Takemoto, Inami-cho (JP)

(73) Assignee: Kabushiki Kaisha Kinki, Kobe-shi, Hyogo (JP)

( * ) Notice: Subject to any disclaimer, the term of this patent is extended or adjusted under 35 U.S.C. 154(b) by 205 days.

(21) Appl. No.: 14/125,925

(22) PCT Filed: Jun. 14, 2012

(86) PCT No.: PCT/JP2012/003890

§ 371 (c)(1), (2), (4) Date: Mar. 17, 2014

(87) PCT Pub. No.: WO2012/172805

PCT Pub. Date: Dec. 20, 2012

(65) Prior Publication Data

US 2014/0190031 A1 Jul. 10, 2014

(30) Foreign Application Priority Data

Jun. 17, 2011 (JP) ..... 2011-135547

(51) Int. Cl.
*F26B 17/14* (2006.01)
*F26B 25/00* (2006.01)
(Continued)

(52) U.S. Cl.
CPC ..... *F26B 25/001* (2013.01); *B02C 13/06* (2013.01); *B02C 13/282* (2013.01);
(Continued)

(58) Field of Classification Search
CPC ..... F26B 9/00; F26B 11/00; F26B 17/00; F26B 17/14; F26B 21/00; F26B 21/06; B02C 17/00; B02C 17/002; B29C 44/00; B29C 44/3461
USPC ..... 34/59, 60, 65, 171, 182; 241/23, 65, 241/188.2; 264/53
See application file for complete search history.

(56) References Cited

U.S. PATENT DOCUMENTS 2,739,391 A * 3/1956 Frederick ..... B86G 3/10 19/4
3,252,228 A * 5/1966 Ehrenfreund ..... B29C 44/3461 264/53

(Continued)

FOREIGN PATENT DOCUMENTS

BG DE 3611808 A1 * 10/1987 ..... B02C 13/04
GB 795079 A 5/1958

(Continued)

OTHER PUBLICATIONS

International Search Report for PCT/JP2012/003890, mailed Sep. 11, 2012.

(Continued)

*Primary Examiner* — Stephen M Gravini
(74) *Attorney, Agent, or Firm* — Marshall, Gerstein & Borun LLP

(57) ABSTRACT

A crushing drying device includes an object-to-be-treated supply port from which an object is supplied into a main body, a crushing portion for crushing the object by hammers rotated on a drive shaft, and a classifying portion having a space for circulating the object to be treated at a position away from the crushing portion, the crushing portion has a dry gas supply port from which the heated air is supplied in a predetermined direction along an inner surface of the device main body, and the classifying portion has discharge portions from which the crushed object is discharged together with the heated air, and deviation plates for changing a flow of the object transferred to the classifying portion, so that the crushing drying device is one machine.

9 Claims, 5 Drawing Sheets

(51) Int. Cl.

| | |
|---|---|
| ***B02C 13/282*** | (2006.01) |
| ***B02C 13/06*** | (2006.01) |
| ***B02C 13/288*** | (2006.01) |
| ***B02C 23/12*** | (2006.01) |
| ***F26B 1/00*** | (2006.01) |
| ***F26B 17/10*** | (2006.01) |
| ***F26B 17/24*** | (2006.01) |
| *B02C 13/286* | (2006.01) |

(52) U.S. Cl.
CPC ..... *B02C 13/288* (2013.01); *B02C 23/12* (2013.01); *F26B 1/005* (2013.01); *F26B 17/107* (2013.01); *F26B 17/24* (2013.01); *B02C 2013/28654* (2013.01); *F26B 2200/24* (2013.01)

(56) References Cited

U.S. PATENT DOCUMENTS 3,400,465 A * 9/1968 Von Stroh ..... F26B 17/04 34/443
3,475,832 A * 11/1969 Kuelling ..... F26B 3/08 34/182
3,682,399 A * 8/1972 Kaspar ..... B02C 17/16 241/172
3,871,111 A * 3/1975 Porr ..... F26B 17/1483 34/168
4,083,679 A * 4/1978 Bade ..... F27D 13/00 106/759
4,276,701 A * 7/1981 Takacs ..... B01F 7/025 241/160
5,330,112 A 7/1994 Nagaoka et al.
5,544,426 A * 8/1996 Yoshida ..... B29B 9/16 34/314
5,570,517 A * 11/1996 Luker ..... F26B 25/04 34/136
5,598,641 A * 2/1997 Kishi ..... E03D 5/00 110/238
5,653,044 A * 8/1997 Thom, Jr. ..... F26B 15/14 34/217
5,664,338 A * 9/1997 Thom, Jr. ..... F26B 25/008 198/952
5,720,439 A * 2/1998 Nakazawa ..... B01J 2/14 241/21
2003/0047038 A1 * 3/2003 Iwasaki ..... C21B 13/10 75/707
2007/0040055 A1 * 2/2007 Riendeau ..... B02C 17/002 241/23

FOREIGN PATENT DOCUMENTS

GB 1180276 A * 2/1970 ..... B24B 5/38
JP 33-5581 4/1958
JP 37-6080 6/1962
JP 37-16784 10/1962
JP 2005-270780 10/2005
JP 2007-147251 A 6/2007
JP 2009-173830 A 8/2009
JP 4475557 B2 * 6/2010
RU WO 2013025120 A1 * 2/2013 ..... B02C 17/16
WO WO-2006-070866 A1 7/2006

OTHER PUBLICATIONS

Extended European Search Report for EP 12 80 0840, dated Jan. 15, 2015.

* cited by examiner

CRUSHING DRYING DEVICE

TECHNICAL FIELD

The present invention relates to a crushing drying device capable of crushing an object to be treated and drying the crushed object to be treated.

BACKGROUND ART

Conventionally, a woody waste, a food waste, and a waste such as sludge are disposed by incineration or burial. However, in recent years, in the fields of environment and energy, there is a trend that some of these wastes which are reusable are used as fuel for $CO_2$ reduction and reuse of valid resource. For example, in a case of the woody waste, the waste is reused as fuel, and in a case of the food waste, the waste is reused as feedstuff or fuel.

In a case where a waste is reused in such a way, the waste is inputted into a crusher as an object to be treated (hereinafter, the above waste will be called as the "object to be treated"), crushed into predetermined size, and then dried by a dryer. As the crusher, a machine provided with a net for adjusting crushing grain size is used in general. As the dryer, a method of drying by a kiln or the like is used in general. A crushing/drying facility in which the crusher and the dryer are systematically provided is installed.

As this type of prior art, for example, there is a crushed item manufacturing device for crushing a material by forcing the material to pass through minute holes of a screen with using wind power of the air heated by a heat exchanger, and supplying the crushed item into a crushed item collector with using the wind power (for example, refer to Patent Document 1).

As another prior art, there are a drying device in which a plurality of radially attached rotors is rotated in a cylindrical container, and water content in an object to be treated inputted from the upper side is separated by impact and centrifugal force by the rotors (for example, refer to Patent Document 2), and a device for making a lignocellulose material into minute particles, including a rotary vane and an intake port for causing a swirling airflow in a bottom part of a cylindrical container, in which by swirling a material on an inner circumference of the cylindrical container, the material is dried and crushed by friction with a wall part in the container (for example, refer to Patent Document 3).

PRIOR ART DOCUMENTS

Patent Documents

Patent Document 1: WO 2006-070866

Patent Document 2: Japanese Patent Laid-open Publication No. 2007-147251

Patent Document 3: Japanese Patent Laid-open Publication No. 2009-173830

SUMMARY OF THE INVENTION

Problems to be Solved by the Invention

However, in a case of a crusher for classifying with a net as described above (including Patent Document 1), an ability of the machine is not easily exerted depending on an object to be treated. Moreover, since there is a high possibility of clogging depending on water content of the object to be treated, there is a fear that an operation rate of the machine is lowered. Since frequent maintenance is required, the machine is not easily stably operated.

Further, in a case where the crushed item is to have a small diameter, there is a need for making a mesh finer. However, in that case, thickness or a net wire diameter is reduced, and strength of the net is lowered or an opening rate is lowered. Thus, there is a fear that crushing efficiency is deteriorated.

Furthermore, in a case where a dryer such as the kiln is used, a drying temperature is relatively high. Thus, for example, for use of crushing to use a recyclable food waste for functional food, there is a fear that transubstantiation of the crushed item or the like is generated, and hence the dryer is unsuitable for reuse of the recyclable food waste. Moreover, since batch treatment is required depending on the drying furnace, there is sometimes a case where the dryer is required to be operated while making adjustment with the crusher. Thus, there is a fear that troublesome operation is required.

In a case of the crushing/drying facility as described above, a crushing process and a drying process are different processes. Thus, an installment area where an individual crusher and an individual dryer are systematically installed is increased, so that a large space is required for arranging the machines, and a transferring unit for transferring the object to be treated between the machines is required. Therefore, size of the entire facility is increased, and a lot of space and cost are required. Furthermore, in a case where a conveyor type drying furnace is adopted as the drying furnace, there is a need for ensuring a conveyor length, so that a facility area is further increased.

Further, the object to be treated crushed and dried as described above has different crushing conditions (crushing grain size) in accordance with a property of the object to be treated, a purpose of use, or the like, and has various drying conditions (water content ratio after drying). Thus, in a case of a facility individually provided with a crusher and a dryer, conditions of the crusher and the dryer are set so as to match with a crushing condition and a drying condition of the object to be treated. However, there is a need for individually setting the machines including a treatment amount between both the machines and the like, and a setting task thereof is highly troublesome and time-consuming.

In Patent Documents 2, 3 described above, various objects to be treated are not easily finely crushed, and crushing and drying in accordance with an object cannot be performed by one machine.

Solutions to the Problems

Thus, an object of the present invention is to provide a crushing drying device capable of crushing in accordance with an object to be treated and drying the crushed object to be treated by one device.

In order to achieve the above object, in the present invention, an object-to-be-treated supply port from which an object to be treated is supplied into a device main body, a crushing portion for crushing the object to be treated supplied from the object-to-be-treated supply port by a crushing element rotated on a drive shaft, and a classifying portion having a space for circulating the object to be treated crushed in the crushing portion at a position away from the crushing portion are provided, the crushing portion has a dry gas supply port from which a dry gas is supplied in a predetermined direction along an inner surface of the device main body, and the classifying portion has a discharge portion from which the crushed object to be treated is discharged together with the dry gas supplied from the crushing portion, and a deviation portion for changing a flow of the object to be treated transferred to the classifying portion together with the dry gas. A hammer, a cutter, or the like is referred to as the "crushing element" in documents of this description and the claims. With this configuration, the object to be treated serving as a solid body supplied from the object-to-be-treated supply port and crushed in the crushing portion is transferred from the crushing portion to the classifying portion along the inner surface of the device main body by the dry gas supplied in the predetermined direction from the dry gas supply port. Since the flow of the object to be treated flowing along the inner surface by centrifugal force in the classifying portion is changed by the deviation portion, active contact with the dry gas is performed and drying is facilitated, so that crushing and drying can be efficiently performed. The deviation portion in the classifying portion is only required to be capable of changing the flow of the object to be treated flowing along the inner surface by the centrifugal force together with the dry gas and facilitating the drying. The object to be treated whose weight becomes predetermined weight or less is discharged to an exterior of the device main body from the discharge portion as a product together with the dry gas. Thus, the object to be treated can be efficiently crushed and dried by one device.

The deviation portion may change the flow of the object to be treated circulated in the classifying portion toward circulation center in the classifying portion. With such a configuration, the flow of the object to be treated in the classifying portion can be directed to the circulation center by the deviation portion. Mixing of the dry gas and the object to be treated is facilitated by a flow change generated by the deviation portion, so that heat exchange efficiency of the drying can be enhanced. Moreover, by changing the flow of the object to be treated toward the circulation center, a discharge ability by classifying suction of the object to be treated discharged from the discharge portion together with the dry gas can also be increased.

The deviation portion may have a support portion on the upstream side in the flow direction of the object to be treated, and include a variable deviation plate capable of changing a downstream end toward the circulation center in the classifying portion centering on the support portion. With such a configuration, by changing an angle of the downstream end of the variable deviation plate toward the circulation center in the classifying portion, a drying ability can be adjusted and the discharge ability for discharging the object to be treated from the discharge portion can be adjusted in accordance with the object to be treated.

The deviation portion may have a predetermined gap providing communication between the classifying portion and an exterior, a dry gas supply portion may be provided in the exterior of the classifying portion, and the dry gas may be supplied to the classifying portion from the dry gas supply portion via the gap. With such a configuration, further mixing of the object to be treated and the dry gas is facilitated by the dry gas supplied to the classifying portion from the gap of the deviation portion, so that the heat exchange efficiency for drying the object to be treated can be further enhanced.

A guide portion for guiding the dry gas supplied from the dry gas supply port toward the classifying portion between the crushing portion and the classifying portion may be provided, and the guide portion may have a slope surface for guiding the object to be treated returned from the classifying portion to the crushing portion to the object-to-be-treated input side of the crushing element. With such a configuration, the flow of the dry gas and the object to be treated circulated in the device main body can be rectified, and the object to be treated which are not yet completely crushed and dried can be returned to the crushing portion together with the dry gas so as to be efficiently re-crushed.

The classifying portion may include the discharge portion in the circulation center part, and the discharge portion may have a discharge pipe portion protruding toward the outer side from a side surface of the device main body, and a discharge port from which the crushed and dried object to be treated is discharged from an outer end of the discharge pipe portion together with the dry gas. With such a configuration, the object to be treated transferred and dried from the crushing portion to the classifying portion, the object having predetermined weight or less, is transferred toward the discharge pipe portion of the discharge portion while being swirled in the classifying portion and discharged from the discharge port. Thus, the object to be treated whose weight becomes predetermined weight or less can be stably discharged.

The classifying portion may include the discharge portion in the circulation center part, and the discharge portion may have a discharge pipe portion protruding toward the inner side of the classifying portion from a side surface of the device main body by a predetermined amount, and a discharge port from which the crushed and dried object to be treated is discharged from an outer end of the discharge pipe portion together with the dry gas. With such a configuration, the object to be treated transferred and dried from the crushing portion to the classifying portion, the object having predetermined weight or less and being swirled and transferred to swirling center of the classifying portion, is discharged from the discharge pipe of the discharge portion to the discharge port. Thus, even the object to be treated having high water content is sufficiently dried, so that the object to be treated whose weight becomes predetermined weight or less can be stably discharged.

The crushing portion may have an object-to-be-treated supply port provided in an axial center part of the drive shaft on which the crushing element is provided, and a rectifying plate for suppressing the object to be treated supplied from the object-to-be-treated supply port from being moved in the axial direction of the drive shaft. With such a configuration, after the object to be treated supplied from the object-to-be-treated supply port is crushed in the crushing portion without being diffused from the axial center part of the crushing portion by the rectifying plate, the object is circulated toward a center part of the classifying portion. The object to be treated returned to and crushed again in the crushing portion is circulated to the classifying portion and dried again while being mixed with the dry gas. Thus, a holding time for drying is extended, so that the object to be treated can be sufficiently dried. Moreover, with suppressing heating unevenness, the sufficiently dried object to be treated can be discharged from the discharge portion.

The object-to-be-treated supply port may be provided with a supplier for supplying the crushed object to the crushing portion by a fixed amount. With such a configuration, a fixed amount of the crushed object is supplied to the crushing portion, so that a stable treatment ability can be exerted.

Effects of the Invention

According to the present invention, the object to be treated can be crushed and dried by one device, a machine installment area can be reduced, and crushing and drying treatment can be performed in accordance with the object to be treated.

EMBODIMENTS OF THE INVENTION

Hereinafter, one embodiment of the present invention will be described based on the drawings. In the following embodiment, a crushing drying device for continuously crushing and drying an object to be treated will be described as an example. An example that the heated air A is used as a dry gas will be described. It should be noted that a concept of the directions in documents of this description and the claims corresponds to a concept of the directions of a state that the left side shown in FIG. 1 is a front surface and the right side is a back surface.

Figure 1:
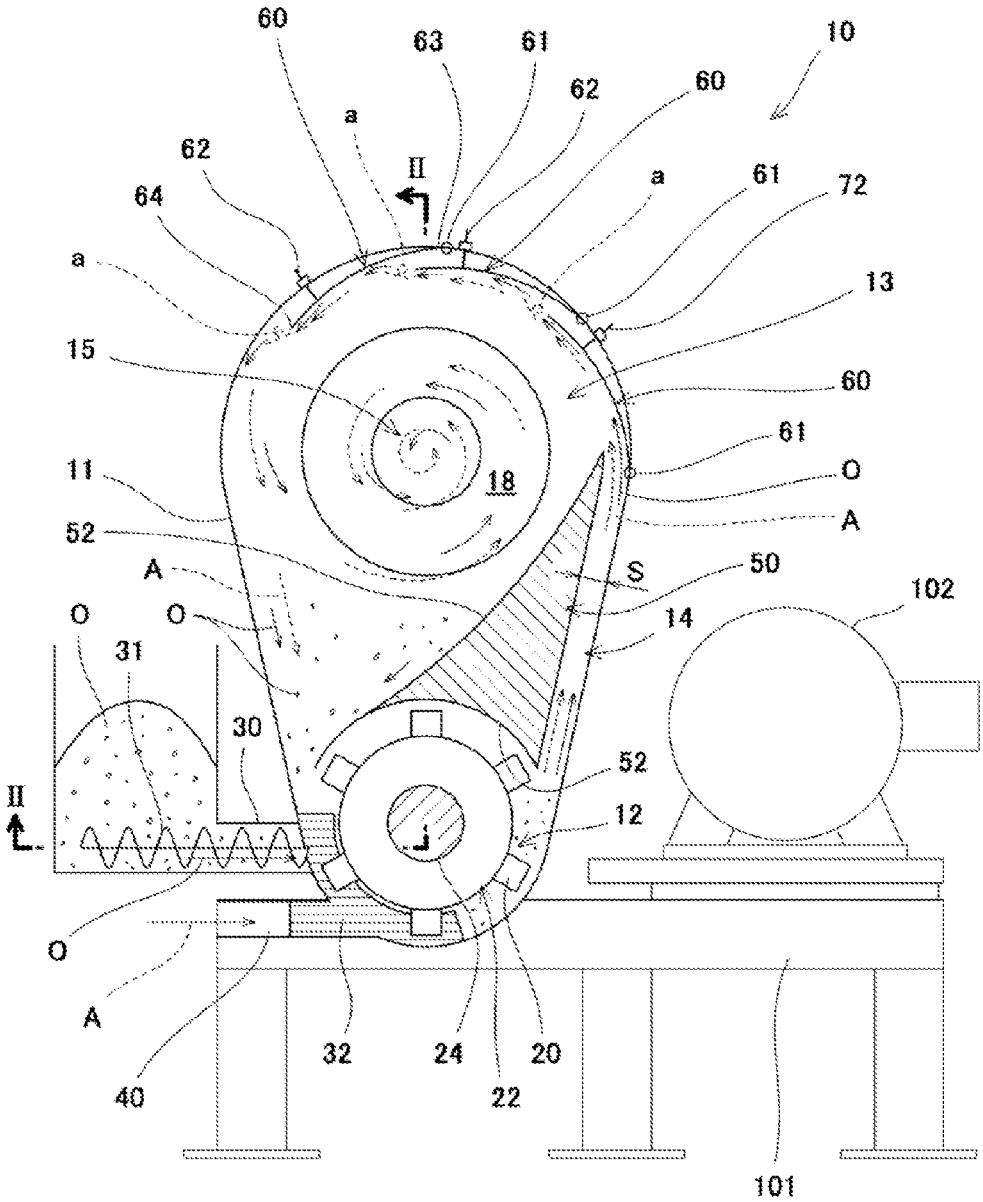
FIG. 1 is a vertically sectional view showing a configuration of a crushing drying device according to a first embodiment of the present invention in a side view.
Figure 2:
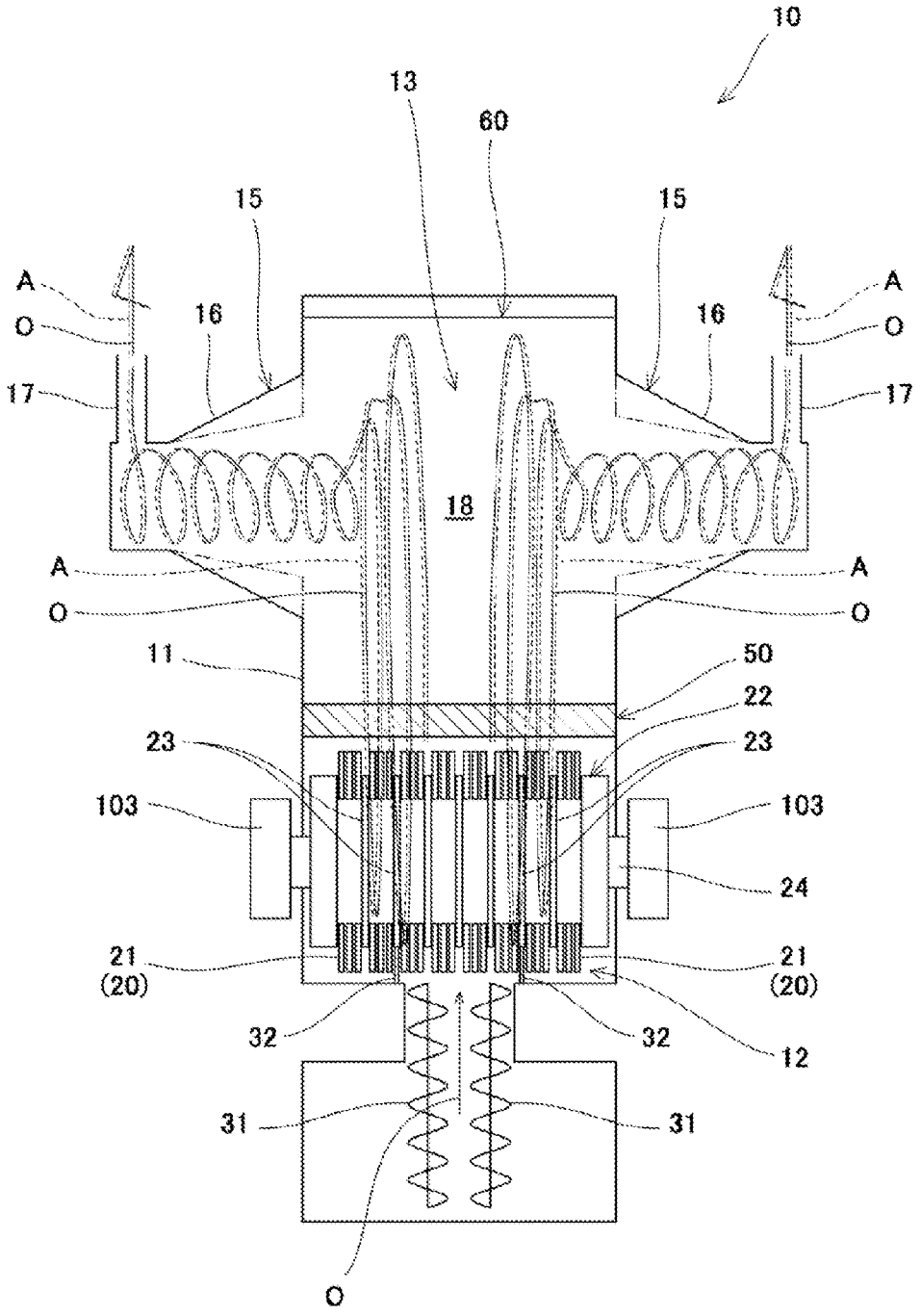
FIG. 2 is a sectional view by line II-II of the crushing drying device shown in FIG. 1.

As shown in FIGS. 1, 2, in a crushing drying device 10 of a first embodiment, a device main body 11 and a driving motor (driving machine) 102 are provided on a mount 101. The device main body 11 is provided with a crushing portion 12 in a lower part thereof, and a classifying portion 13 in an upper part thereof. A transferring portion 14 is formed between the crushing portion 12 and the classifying portion 13. In a side view, the device main body 11 of this embodiment is formed into a vertically long shape in which the crushing portion 12 is a semicircle having a small diameter, the classifying portion 13 is a semicircle having a large diameter, and these portions are connected by the linearly extending transferring portion 14. The classifying portion 13 is formed in size having a space 18 in which an object to be treated 0 crushed in the crushing portion 12 can be circulated.

A rotor 22 provided with hammer bodies 21 around which a plurality of hammers (crushing elements) 20 is formed is arranged in the crushing portion 12. In the rotor 22 of this embodiment, the three-ply hammer body 21 serves as one set, a spacer 23 having predetermined thickness is provided between the three-ply hammer bodies 21, and these hammer bodies 21 and the spacers 23 are alternately inserted and fixed to a drive shaft 24. By the spacers 23, intervals between the plurality of hammer bodies 21 provided in the axial direction of the drive shaft 24 are maintained. In this rotor 22, the drive shaft 24 is supported in the horizontal direction by bearings 103 provided in the mount 101. The rotor 22 of this embodiment is an example that the object to be treated O is hit and crushed by rotating leading ends of the hammers 20 at high speed of tens of m/s (such as 70 m/s). The rotor 22 is rotated by belt-driving one end of the drive shaft 24 by the driving motor 102.

The hammers 20 provided in the axial direction of the rotor 22 may be selected in accordance with a property of the object to be treated O, crushing grain size, or the like. The axial arrangement of the hammers 20 may be selected in accordance with the object to be treated O among a linear form in which the hammers are aligned in one straight line, a zigzag form in which the hammers are alternately displaced in the circumferential direction, and the like. The hammers 20 may be swing hammers whose leading end side is oscillated or circular ring hammers, and a type of the hammers may be selected in accordance with the property or the like of the object to be treated O. Further, in this embodiment, the hammers are described as an example of a crushing element. However, cutters or the like may be used depending on the object to be treated O or the crushing grain size.

Discharge portions 15 from which the object to be treated O is discharged together with the heated air A are provided in a circulation center part positioned in a center part of the semicircle of the classifying portion 13. The discharge portions 15 are provided on both sides of the device main body 11, and provided concentrically to the classifying portion 13. The discharge portions 15 of this embodiment have reduced diameter portions 16 serving as discharge pipe portions protruding from both side surfaces of the device main body 11 with diameters being reduced, and discharge ports 17 provided in top protruding parts of the reduced diameter portions 16. With the reduced diameter portions 16 of the discharge portions 15, the heated air A circulated in the classifying portion 13 is smoothly suctioned toward the discharge ports 17. The discharge ports 17 are connected to a cyclone separator (not shown) via pipes, and the internal air is suctioned by a discharge fan.

The reduced diameter portions 16 of this embodiment are formed in such a manner that the diameters are largely reduced from the main body side surfaces toward the discharge ports 17. However, this diameter reduction amount is determined in accordance with the property of the object to be treated O such as a water content amount, grain size, and specific gravity, and set to be such a diameter reduction amount that the object to be treated O is circulated until the object is dried in the classifying portion 13. For example, in a case where the water content amount is small, the reduced diameter portions 16 as shown in the figure are formed, so that the object to be treated O dried in the classifying portion 13 is promptly discharged from the discharge ports 17. Meanwhile, in a case where the water content amount is large, as shown by double chain lines, diameters of side surface sides of the device main body 11 are reduced, so that the diameter reduction amount is decreased. By circulating the object to be treated O for a long time in the classifying portion 13, the object to be treated O is sufficiently dried and then discharged from the discharge ports 17. In this case, the reduced diameter portions 16 may sometimes be discharge pipe portions of the same diameter pipes. Further, an amount of protrusion of the reduced diameter portions 16 from the side surfaces of the device main body 11 is also determined in accordance with the property of the object to be treated O such as the water content amount, the grain size, and the specific gravity.

Meanwhile, on the front surface side of the device main body 11, an object-to-be-treated supply port 30 from which the object to be treated O is supplied to an axial center part of the drive shaft 24 provided with the hammers 20 is provided. With this object-to-be-treated supply port 30, the object to be treated O is inputted from a position lower than axial center of the drive shaft 24 of the rotor 22. Solid arrows in the figure show a flow of the object to be treated O.

This object-to-be-treated supply port 30 is provided with a screw conveyor 31 serving as a fixed-amount supplier for supplying a predetermined amount of the object to be treated O by a fixed amount. In this embodiment, the screw conveyor 31 is used as the fixed-amount supplier. However, the fixed-amount supplier may be another configuration in accordance with the object to be treated O.

In a part of the object-to-be-treated supply port 30 in the axial direction of the drive shaft 24, rectifying plates 32 (shown by traverse lines in the figure) for supplying the object to be treated O to a lower part of the rotor 22 are provided so as to have width which is slightly wider than width size of this object-to-be-treated supply port 30. The rectifying plates 32 are provided at positions of the spacers 23. By the rectifying plates 32, the object to be treated O supplied and circulated from the object-to-be-treated supply port 30 is not spread in the axial direction (width direction) until the object reaches a lower part position of the device main body 11.

In such a way, by providing the rectifying plates 32 from a part of the object-to-be-treated supply port 30 so as to continue to the lower part of the device main body 11, the object to be treated O supplied from the object-to-be-treated supply port 30 is crushed in a center part of the rotor 22.

Further, on the front surface side of the device main body 11 on the lower side of the object-to-be-treated supply port 30, a dry gas supply port 40 from which the heated air A (dry gas; including the dry air and the like) is supplied toward the lower side of the rotor 22 is provided. The heated air A supplied from this dry gas supply port 40 is supplied from the entire width direction of the device main body 11, and smoothly flows from the lower side of the rotor 22 in the predetermined direction along a back surface side inner surface of the device main body 11. Dotted arrows in the figure show a flow of the heated air A.

Superheated steam may be used as the heated air A. Under the superheated steam, heating is performed by condensation heat transfer at the time of condensing the superheated steam on a surface of the object to be treated O in addition to convection heat transfer. Thus, a large amount of heat is given to the object to be treated O, so that the heating can be rapidly advanced. Moreover, there is a characteristic that condensation is preferentially caused in a low-temperature part, so that heating unevenness can be suppressed. Under the superheated steam, since the originally existing air is driven off, oxygen concentration can be lowered and drying can be performed while suppressing oxidation. Thus, the superheated steam is suitable for crushing and drying of the object to be treated O in which chemical reaction of food and the like are to be suppressed.

With such a configuration, the object to be treated O supplied from the object-to-be-treated supply port 30 and crushed in the crushing portion 12 is circulated from a center part of the device main body 11 toward the classifying portion 13 together with the heated air A supplied from the dry gas supply port 40. The object to be treated O returned to the crushing portion 12 again after spreading in the width direction by suction from the discharge portions 15 in the classifying portion 13 is returned to positions slightly spread from an axial center part of the rotor 22 and re-crushed. By repeating this, the crushing in the crushing portion 12 and the drying and classification in the classifying portion 13 are efficiently performed.

On the upper side of the rotor 22, a guide member 50 having an arc shape guide surface 51 with a predetermined gap from a rotation trajectory in a leading end of the rotor 22 in a side view is arranged. This guide member 50 is a guide portion. On the raising side where the object to be treated O is moved from the crushing portion 12 to the classifying portion 13 in a side view, a predetermined interval S is provided from a vertical wall surface of the device main body 11. An upper end of this guide member 50 extends to the vicinity of the same height as the circulation center part of the classifying portion 13, so that the object to be treated O and the heated air A raised to the classifying portion 13 are smoothly circulated along the inner surface of the device main body.

On the lowering side where the object to be treated O is returned from the classifying portion 13 to the crushing portion 12, a slope surface 52 is formed to be inclined from an upper end on the raising side toward the rotation upstream side of the rotor 22. Moreover, the slope surface 52 of this example is formed so as to be a gentle concavely-curved surface from the upper end of the raising side to the center part of the device main body 11, and then smoothly continue toward an end on the rotation upstream side of the rotor 22 by a convexly-curved surface. By providing the guide member 50 whose upper surface is formed by such a curved slope surface 52, there is a rectifying effect in which an airflow generated by rotation of the rotor 22 does not adversely influence the airflow in the classifying portion 13 on the upper side of the rotor. In such a way, the object to be treated O returned from the classifying portion 13 to the crushing portion 12 is smoothly returned to the rotation upstream side of the rotor 22 along the slope surface 52.

Regarding the drying of the object to be treated O crushed in the crushing portion 12, the heated air A is fed during the crushing in the crushing portion 12 and the drying is also performed by thermal energy converted from crushing energy. Thus, the drying is advanced at the same time as the crushing, so that a drying mechanism can efficiently dry the object to be treated O by the thermal energy of the heated air A. Further, by crushing, a surface area of the object to be treated O is increased, so that the drying is quickened. Moreover, by crushing impact, internal pressure applied to the object to be treated O is increased, and inside water content is discharged to an exterior to become surface water. Thus, the drying is also facilitated. Furthermore, by rotating the rotor 22 at high speed as described above, the object to be treated O flows and is moved in a high-speed airflow, so that drying speed can be improved. In such a way, by early drying the object to be treated O and flying the object up to the classifying portion 13 together with the heated air A as described above, the object to be treated O is efficiently dried and the dried object is firstly discharged to an exterior of the device.

In the space 18 of the classifying portion 13, by floating up the crushed object to be treated O together with the heated air A as shown by one-chain lines and dotted lines, and suctioning the heated air A of this classifying portion 13 from the discharge portions 15 by predetermined suction force, the crushed and dried object to be treated O whose weight becomes predetermined weight or less is discharged to the exterior of the device together with the heated air A. The lines of the object to be treated O and the heated air A shown in the figure indicate images of floating and discharging.

However, when the object to be treated O transferred to the classifying portion 13 is crushed in the crushing portion 12 and transferred together with the heated air A supplied from the dry gas supply port 40 along the inner surface of the device main body 11, there is sometimes a case where the object to be treated O is transferred along the inner surface of the device main body 11 on the outer side of the heated air A by centrifugal force.

Thus, in this embodiment, in order to facilitate the drying of the object to be treated O in the classifying portion 13, variable deviation plates 60 serving as deviation portions are provided on an inner surface of the classifying portion 13. In this variable deviation plate 60, a support portion (hinge) 61 is provided in an upstream side end 63 where the object to be treated O is circulated, and an angle of a downstream side end 64 can be changed toward the center part of the classifying portion 13 centering on this support portion 61. Angle adjustment of the variable deviation plate 60 is adjustable by an adjustment bolt 62 provided in the device main body 11 from the exterior. This variable deviation plate 60 is formed by an arc which is similar to the width direction size of the device main body 11 and substantially equal to an arc of the classifying portion 13. In this embodiment, three variable deviation plates 60 are provided. In the variable deviation plate 60 on the most upstream side, the support portion 61 is provided at a position lower than the upper end of the guide member 50.

Thereby, the object to be treated O and the heated air A passing through the predetermined interval S between the guide member 50 and the device main body 11 and reaching the classifying portion 13 flow from the vicinity of an outlet of the guide member 50 along an inner surface of the variable deviation plate 60. In the variable deviation plate 60, the angle of the downstream side end 64 is changeable toward the circulation center of the classifying portion 13. It should be noted that this variable deviation plate 60 may be a variable deviation plate fixed at an angle which is suitable for the object to be treated O.

By providing such variable deviation plates 60, the object to be treated O and the heated air A transferred along the inner surface of the device main body 11 are mixed by swirling currents a of airflows generated in the downstream side ends 64 of the variable deviation plates 60. Thus, the drying can be facilitated by mixing the object to be treated O of a solid body and the heated air A of a gas.

By suctioning the air of the classifying portion 13 from the discharge portions 15, the object to be treated O whose crushing and drying are completed is suctioned together with the heated air A and discharged from the crushing drying device 10. At this time, the water content and the grain size of the conveyable object to be treated O can be adjusted depending on an air volume (wind speed) of the air suctioned by the discharge portions 15. That is, the fact that the weight of the object to be treated O is changed by the grain size and the water content amount is utilized. When the object to be treated O is crushed into predetermined grain size and dried, the object is discharged from the discharge portions 15. When the object is not yet crushed into the predetermined grain size and not sufficiently dried, the object is not discharged but remains in the device main body 11. Whether or not the crushing and the drying of the object to be treated O are completed is determined by whether or not the object is suctioned and discharged from the discharge portions 15.

As described above, according to the crushing drying device 10 of the above first embodiment, the object to be treated O is supplied from the object-to-be-treated supply port 30 by the screw conveyor 31 by a fixed amount, and the heated air A is supplied from the dry gas supply port 40 along the inner surface of the device main body 11.

The object to be treated O supplied from the object-to-be-treated supply port 30 by a fixed amount is crushed in the center part of the rotor 22 by the rectifying plates 32, and transferred to the classifying portion 13 on the upper side along the back surface side inner surface of the device main body 11 by the heated air A supplied from the dry gas supply port 40.

The object to be treated O transferred to the classifying portion 13 together with this heated air A is mixed by the swirling currents a of the heated air A generated in the downstream side ends 64 of the variable deviation plates 60 on the inner surface of the device main body 11 in the classifying portion 13, so that heat exchange efficiency for drying the object to be treated O by the heated air A can be enhanced. Therefore, the drying of the object to be treated O is facilitated, so that early drying can be performed.

The crushed and dried object to be treated O whose weight becomes predetermined weight or less in the classifying portion 13 is suctioned and discharged to the discharge ports 17 of the discharge portions 15 as described above. In such a way, mixing of the object to be treated O and the heated air A crushed in the crushing portion 12 and flied up to the classifying portion 13 is facilitated and the heat exchange efficiency is enhanced. Thus, the crushed and dried object to be treated O whose weight becomes predetermined weight or less is successively discharged to the exterior of the device, so that the object to be treated O such as wood chips can be efficiently treated.

Further, the not-sufficiently crushed and dried object to be treated O is not suctioned from the discharge portions 15 but transferred to the side of the object-to-be-treated supply port 30 of the crushing portion 12 by a flow of the heated air A and the guide member 50 provided on the upper side of the rotor 22 of the crushing portion 12, and re-crushed by the hammers 20 of the rotor 22. Moreover, this re-crushed object to be treated O includes the object after removing the crushed and dried object to be treated O whose weight becomes predetermined weight or less and a newly-supplied object to be treated O. Thus, the object can be crushed without excessive crushing.

After that, the object to be treated O re-crushed in the crushing portion 12 together with the new object to be treated O is transferred to the classifying portion 13 and circulated together with the heated air A as described above. The dried object to be treated O whose weight becomes predetermined weight or less is discharged from the discharge ports 17 of the discharge portions 15 together with the heated air A. The object to be treated O not discharged from the discharge portions 15 is returned to the crushing portion 12 as described above, and re-crushing is repeated. Since the not-sufficiently crushed and dried object to be treated O is also re-crushed, the object can be efficiently crushed.

Moreover, the above crushed and dried object to be treated O whose weight becomes predetermined weight or less is successively discharged. Thus, by newly supplying a decrease amount of the discharged object to be treated O from the object-to-be-treated supply port 30, the object to be treated O can be continuously crushed and dried, so that a large amount of products obtained by crushing and drying the object to be treated O can be produced by one crushing drying device 10.

Figure 3:
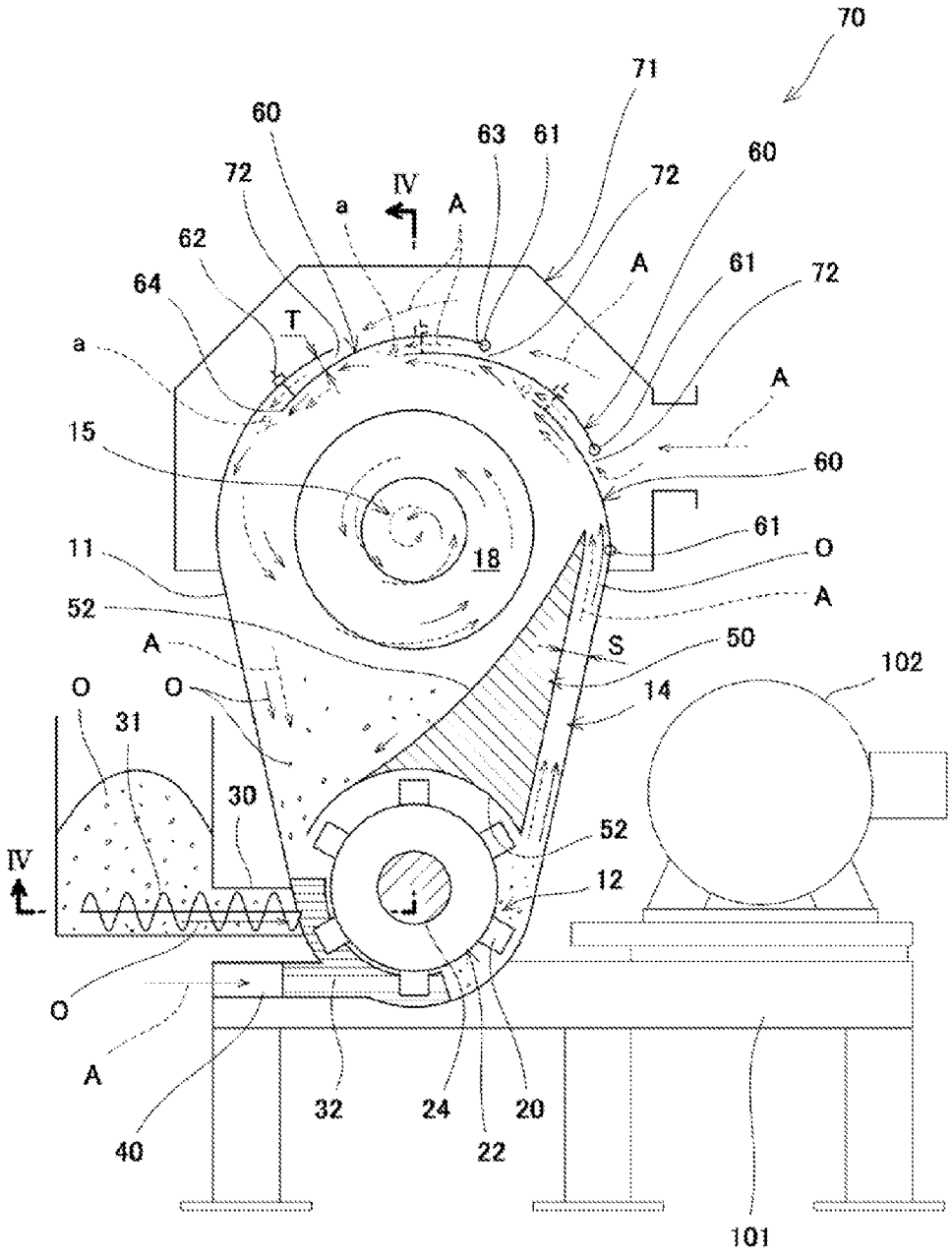
FIG. 3 is a vertically sectional view showing a configuration of a crushing drying device according to a second embodiment of the present invention in a side view.
Figure 4:
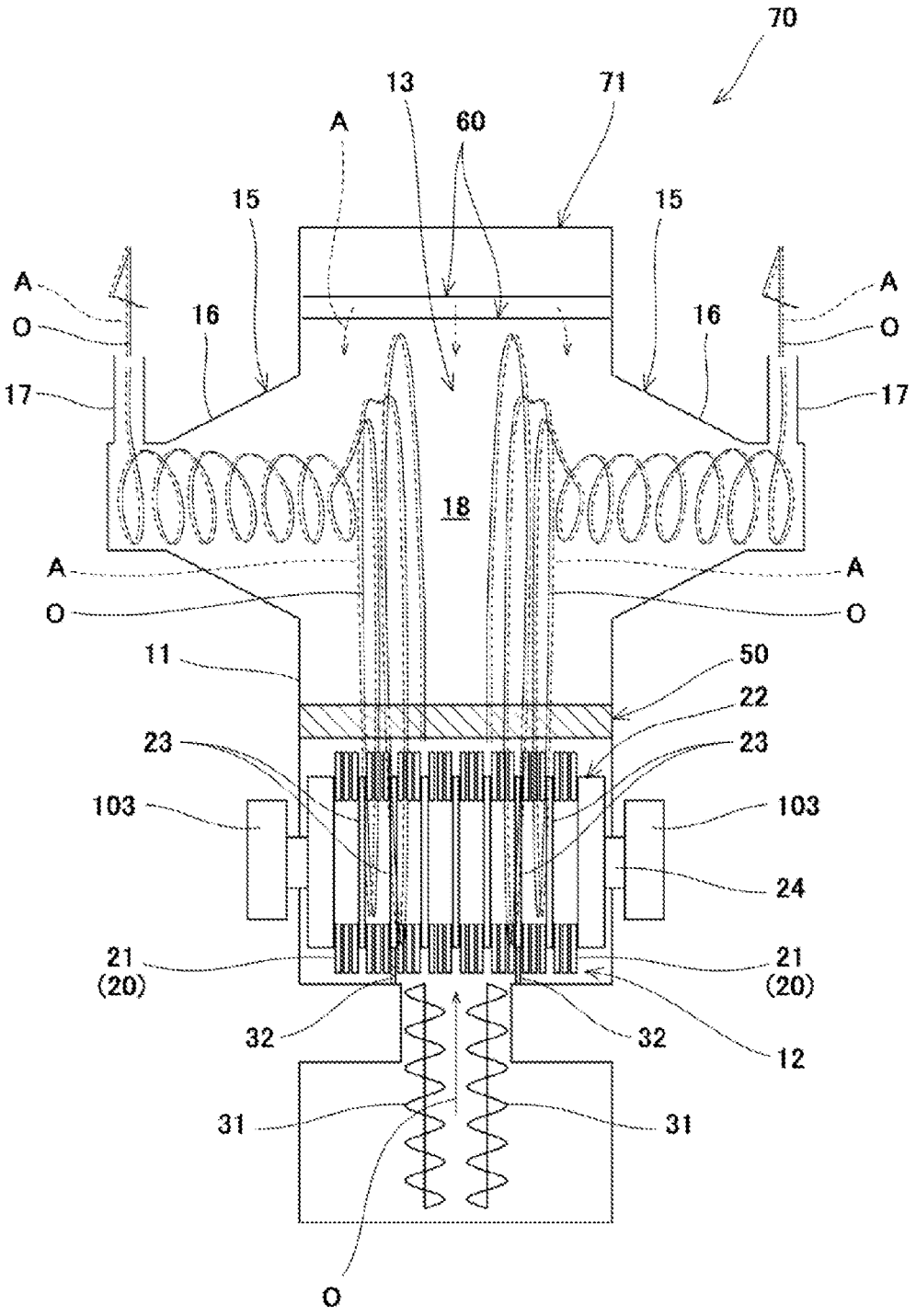
FIG. 4 is a sectional view by line IV-IV of the crushing drying device shown in FIG. 3.

A crushing drying device 70 of a second embodiment shown in FIGS. 3, 4 is an embodiment in which the heated air A is supplied from the exterior of the device main body 11 in the classifying portion 13 of the crushing drying device 10 of the above first embodiment. It should be noted that since the other configurations are the same as the crushing drying device 10 of the above first embodiment, the same configurations will be given the same reference signs and detailed description thereof will be omitted.

As shown in FIG. 3, the crushing drying device 70 of the second embodiment is provided with a dry gas supply portion 71 in an exterior of the classifying portion 13. This dry gas supply portion 71 is formed with the width direction size of the device main body 11, and formed in size surrounding the support portions 61 of the variable deviation plates 60.

In the variable deviation plate 60 of this embodiment, the support portion (hinge) 61 is also provided in the upstream side end 63 where the object to be treated O is circulated, and the angle of the downstream side end 64 can be changed toward the center part of the classifying portion 13 centering this support portion 61. Moreover, in this embodiment, by changing the angle of the downstream side end 64 of the variable deviation plate 60 toward the center of the classifying portion 13, a gap T is formed between the downstream side end 64 and the upstream side end 63 of the variable deviation plate 60.

This part of the gap T serves as a dry gas supply port 72 from which the heated air A (dry gas) is supplied from the dry gas supply portion 71 to the classifying portion 13. This dry gas supply port 72 is provided on the upstream side in the circulation direction of the object to be treated O in the classifying portion 13. By providing this dry gas supply port 72 on the circulation upstream side of the object to be treated of the variable deviation plate 60, the dry gas A enters the classifying portion 13 from the gap T from the upstream side end 63 of the downstream side variable deviation plate 60, the gap being generated when the angle of the downstream side end 64 is changed by the variable deviation plate 60 centering on the support portion 61 but the object to be treated O does not come into the dry gas supply portion 71. As the heated air (dry gas) A supplied from the dry gas supply portion 71, the same one as the heated air A supplied to the crushing portion 12 is utilized.

According to the crushing drying device 70 of the second embodiment formed as above, as well as the crushing drying device 10 of the above first embodiment, regarding the object to be treated O crushed in the crushing portion 12 and flied up to the classifying portion 13, whether or not the crushing and the drying are performed is determined by whether or not the object is suctioned from the discharge portions 15, and the crushed and dried object to be treated O whose weight becomes predetermined weight or less is discharged to the exterior of the device. Thus, the object to be treated O can be efficiently crushed and dried by one machine.

Moreover, according to this second embodiment, since the heated air A is also supplied to the classifying portion 13 from the dry gas supply portion 71, the object to be treated O and the heated air A is further mixed by swirling currents a of the heated air A flowing into the classifying portion 13 from this dry gas supply portion 71 through the gaps T between the downstream side ends 64 and the upstream side ends 63 of the variable deviation plates 60. Thus, the object to be treated O can be dried more than the above first embodiment. Therefore, the object to be treated O such as sludge can be efficiently crushed and dried.

In this second embodiment, the object to be treated O whose weight is not yet predetermined weight or less, the object being not discharged from the discharge portions 15, is also transferred to the side of the object-to-be-treated supply port 30 of the crushing portion 12 by the flow of the heated air A and re-crushed by the rotor 22. Moreover, in this embodiment, the object to be treated O returned from the classifying portion 13 to the crushing portion 12 can also be returned along the guide member 50. The flow of the object to be treated O and the heated air A in the device main body 11 can be stabilized in one direction, so that the object to be treated O can be efficiently crushed and dried.

Figure 5:
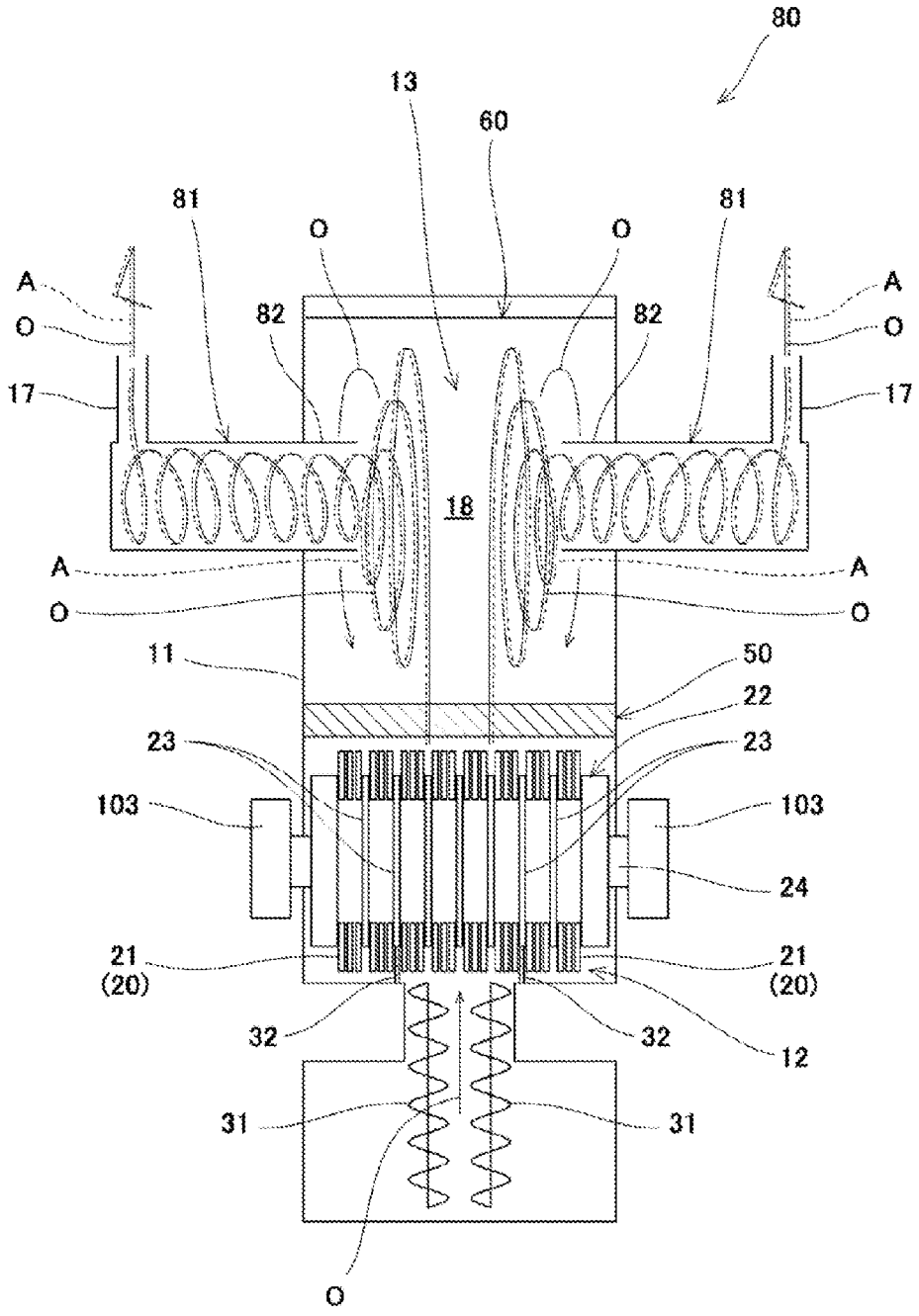
FIG. 5 is a sectional view showing the same section as FIG. 2 of a crushing drying device according to a third embodiment of the present invention.

A crushing drying device 80 of a third embodiment shown in FIG. 5 is an embodiment in which discharge portions 81 are different in the crushing drying device 10 of the above first embodiment. The same configurations as the crushing drying device 10 of the above first embodiment will be given the same reference signs and detailed description thereof will be omitted.

The discharge portions 81 of the crushing drying device 80 in the third embodiment have discharge pipe portions 82 protruding to the inner side of the classifying portion 13 from the side surfaces of the device main body 11 by a predetermined amount, and discharge ports 17 for discharging the crushed and dried object to be treated O from outer ends of the discharge pipe portions 82 together with the dry gas. The discharge pipe portions 82 of this embodiment are formed by pipe bodies having the same diameter in the longitudinal direction. However, the discharge pipe portions may be formed into such a shape that a part protruding to the inner side of the device main body 1 has a large diameter and a part on the side of the discharge port 17 has a small diameter (shape as in the first embodiment).

The predetermined amount by which the discharge pipe portions 82 protrude to the inner side from the side surfaces of the device main body 11 is determined in accordance with the property such as the water content amount contained in the object to be treated O, the grain size, and the specific gravity, and set to be such a length that the object to be treated O is circulated until the object is dried in the classifying portion 13. For example, the amount is set to be longer than about tens of mm in such a manner that the circulated object to be treated O is discharged from the discharge pipe portions 82 at positions away from the inner surface. Whether the discharge pipe portions 82 protrude to the inner side from the side surfaces of the device main body 11 as in this third embodiment or not protrude to the inner side from the side surfaces as in the first embodiment is also determined in accordance with the property such as the water content amount contained in the object to be treated O, the grain size, and the specific gravity.

In this third embodiment, the configuration of the crushing drying device 10 in the first embodiment is described as an example. However, the third embodiment is not limited to the configuration of the first embodiment but may be applied to the configuration of the crushing drying device 70 of the second embodiment.

As described above, according to the crushing drying device 80 of the third embodiment formed as above, regarding the object to be treated O crushed in the crushing portion 12 and flied up to the classifying portion 13, whether or not the crushing and the drying are performed is determined by whether or not the object is suctioned from the discharge pipe portions 82 of the discharge portions 81, and the crushed and dried object to be treated O whose weight becomes predetermined weight or less is discharged to the exterior of the device. Thus, the object to be treated O can be efficiently crushed and dried by one machine.

Moreover, according to the crushing drying device 80 of this third embodiment, the object to be treated O swirled along the inner surface of the device main body 11 in the classifying portion 13 is not swirled around the discharge pipe portions 82 protruding to the inner side from the side surface of the device main body 11 by the predetermined amount and discharged from the discharge pipe portions 83. Thus, the object to be treated O containing a lot of water content can be suppressed from being discharged from the discharge ports 17 before being dried.

It should be noted that although the embodiments in which the crushing portion 12 is provided in the lower part and the classifying portion 13 is provided in the upper part are described in the above embodiments, for example, a configuration that the crushing portion 12 and the classifying portion 13 are laterally arranged may be adopted. A positional relationship between the crushing portion 12 and the classifying portion 13 is not limited to the above embodiments.

Size of the semicircle in the crushing portion 12 of the device main body 11 and the semicircle in the classifying portion 13 in the above embodiments are one example. For example, when a space of the classifying portion 13 is widened by further increasing the semicircle in the classifying portion 13, more amounts of the object to be treated O can be dried. Thus, the size of the crushing portion 12 and the classifying portion 13 is not limited to the above embodiments but may be determined in accordance with the object to be treated O, a treatment condition, or the like.

Further, although the example in which the rectifying plates 32 for sending the object to be treated O to the axial center part of the rotor 22 are provided is shown in the above embodiments, the rectifying plates 32 are not necessarily provided depending on the object to be treated O. Whether or not the rectifying plates 32 are provided may be selectively determined in accordance with the object to be treated O, the configuration of the hammers (crushing elements) 20, or the like.

Since the variable deviation plates 60 are described as one example of the deviation portions in the above embodiments, the deviation portions may have a configuration other than the variable deviation plates 60. For example, fixed deviation portions formed by making the inner surface of the classifying portion 13 concave and convex, fixed deviation plates, or other configurations may be adopted. The deviation portions are not limited to the above embodiments.

Further, the above embodiments show one example, the configurations of the embodiments may be combined, and various changes can be made within a range not deteriorating the gist of the present invention. The present invention is not limited to the above embodiments.

Industrial Applicability

The crushing drying device according to the present invention can be utilized in a case where the object to be treated required to be crushed into fine particles and removed the water content is to be crushed and dried by one machine.

DESCRIPTION OF REFERENCE SIGNS

10: Crushing drying device
11: Device main body
12: Crushing portion
13: Classifying portion
14: Transferring portion
15: Discharge portion
16: Reduced diameter portion (discharge pipe portion)
17: Discharge port
18: Space
20: Hammer (crushing element)
21: Hammer body
22: Rotor
23: Spacer
24: Drive shaft
30: Object-to-be-treated supply port
31: Screw conveyor (supplier)
32: Rectifying plate
40: Dry gas supply port
50: Guide member (guide portion)
51: Guide surface
52: Slope surface
60: Variable deviation plate (deviation portion)
61: Support portion (hinge)
62: Adjustment bolt
63: Upstream side end
64: Downstream side end
70: Crushing drying device
71: Dry gas supply portion
72: Dry gas supply port
80: Crushing drying device
81: Discharge portion
82: Discharge pipe portion
A: Heated air (dry gas)
O: Object to be treated
S: Interval
T: Gap

The invention claimed is:

1. A crushing drying device, comprising: an object-to-be-treated supply port from which an object to be treated is supplied into a device main body;

a crushing portion for crushing the object to be treated supplied from the object-to-be-treated supply port by a crushing element rotated on a drive shaft; and a classifying portion having a space for circulating the object to be treated crushed in the crushing portion at a position away from the crushing portion, wherein the crushing portion has a dry gas supply port from which a dry gas is supplied in a predetermined direction along an inner surface of the device main body, and the classifying portion has a discharge portion from which the crushed object to be treated is discharged together with the dry gas supplied from the crushing portion, and a deviation portion for changing a flow of the object to be treated transferred to the classifying portion together with the dry gas.

2. The crushing drying device according to claim 1, wherein the deviation portion changes the flow of the object to be treated circulated in the classifying portion toward circulation center in the classifying portion.

3. The crushing drying device according to claim 1, wherein the deviation portion has a support portion on the upstream side in the flow direction of the object to be treated, and includes a variable deviation plate capable of changing a downstream end toward the circulation center in the classifying portion centering on the support portion.

4. The crushing drying device according to claim 1, wherein the deviation portion has a predetermined gap providing communication between the classifying portion and an exterior, a dry gas supply portion is provided in the exterior of the classifying portion, and the dry gas is supplied to the classifying portion from the dry gas supply portion via the gap.

5. The crushing drying device according to claim 1, having a guide portion for guiding the dry gas supplied from the dry gas supply port toward the classifying portion between the crushing portion and the classifying portion, wherein the guide portion has a slope surface for guiding the object to be treated returned from the classifying portion to the crushing portion to the object-to-be-treated input side of the crushing element.

6. The crushing drying device according to claim 1, wherein the classifying portion includes the discharge portion in the circulation center part, and the discharge portion has a discharge pipe portion protruding toward the outer side from a side surface of the device main body, and a discharge port from which the crushed and dried object to be treated is discharged from an outer end of the discharge pipe portion together with the dry gas.

7. The crushing drying device according to claim 1, wherein the classifying portion includes the discharge portion in the circulation center part, and the discharge portion has a discharge pipe portion protruding toward the inner side of the classifying portion from a side surface of the device main body by a predetermined amount, and a discharge port from which the crushed and dried object to be treated is discharged from an outer end of the discharge pipe portion together with the dry gas.

8. The crushing drying device according to claim 1, wherein the crushing portion has an object-to-be-treated supply port provided in an axial center part of the drive shaft on which the crushing element is provided, and a rectifying plate for suppressing the object to be treated supplied from the object-to-be-treated supply port from being moved in the axial direction of the drive shaft.

9. The crushing drying device according to claim 1, wherein the object-to-be-treated supply port is provided with a supplier for supplying the crushed object to the crushing portion by a fixed amount.

* * * * *